United States Patent [19]

Peterson

[11] 4,359,210

[45] Nov. 16, 1982

[54] TEMPERATURE CONTROL APPARATUS

[75] Inventor: Curtis P. Peterson, Rochester, Wis.

[73] Assignee: Crucible Inc., Pittsburgh, Pa.

[21] Appl. No.: 226,989

[22] Filed: Jan. 21, 1981

[51] Int. Cl.[3] ..... H05B 5/04

[52] U.S. Cl. ..... 266/87; 266/96; 219/10.77; 373/148

[58] Field of Search ..... 266/80, 87, 90, 96; 148/128; 236/15 BB, 15 BC, 15 BG, 46 F; 219/10.69, 10.77; 373/148

[56] References Cited

U.S. PATENT DOCUMENTS

| | | | |
|---|---|---|---|
| 1,512,008 | 10/1924 | Otis | 266/87 X |
| 2,813,186 | 11/1957 | Bock | 219/10.77 X |
| 3,614,366 | 10/1971 | Huchok | 219/10.69 |
| 3,743,808 | 7/1973 | Kasper | 266/80 X |

*Primary Examiner*—G. O. Peters

*Attorney, Agent, or Firm*—Clair X. Mullen, Jr.

[57] ABSTRACT

Apparatus for controlling furnace temperature particularly in an annealing furnace used for annealing elongated product, such as pipe and tubing, on a continuous basis. The apparatus includes a pyrometer used to produce an electrical signal proportional to the temperature of the workpiece immediately after heating by an induction coil in the furnace, means for comparing this electrical signal to a set point signal proportional to the desired temperature of the workpiece and if these signals differ a control signal is produced to either increase or decrease the power input to the induction coil to correspondingly increase or decrease the temperature of the workpiece to the desired temperature. The comparison of the pyrometer signal and the set point signal is made at time intervals corresponding to the speed of the product through the furnace and the distance between the induction coil and the pyrometer so that in the presence of an error signal indicating temperature deviation from the set point a second error signal is not produced until the affect of the power level correction in response to the first error signal is effected.

3 Claims, 1 Drawing Figure

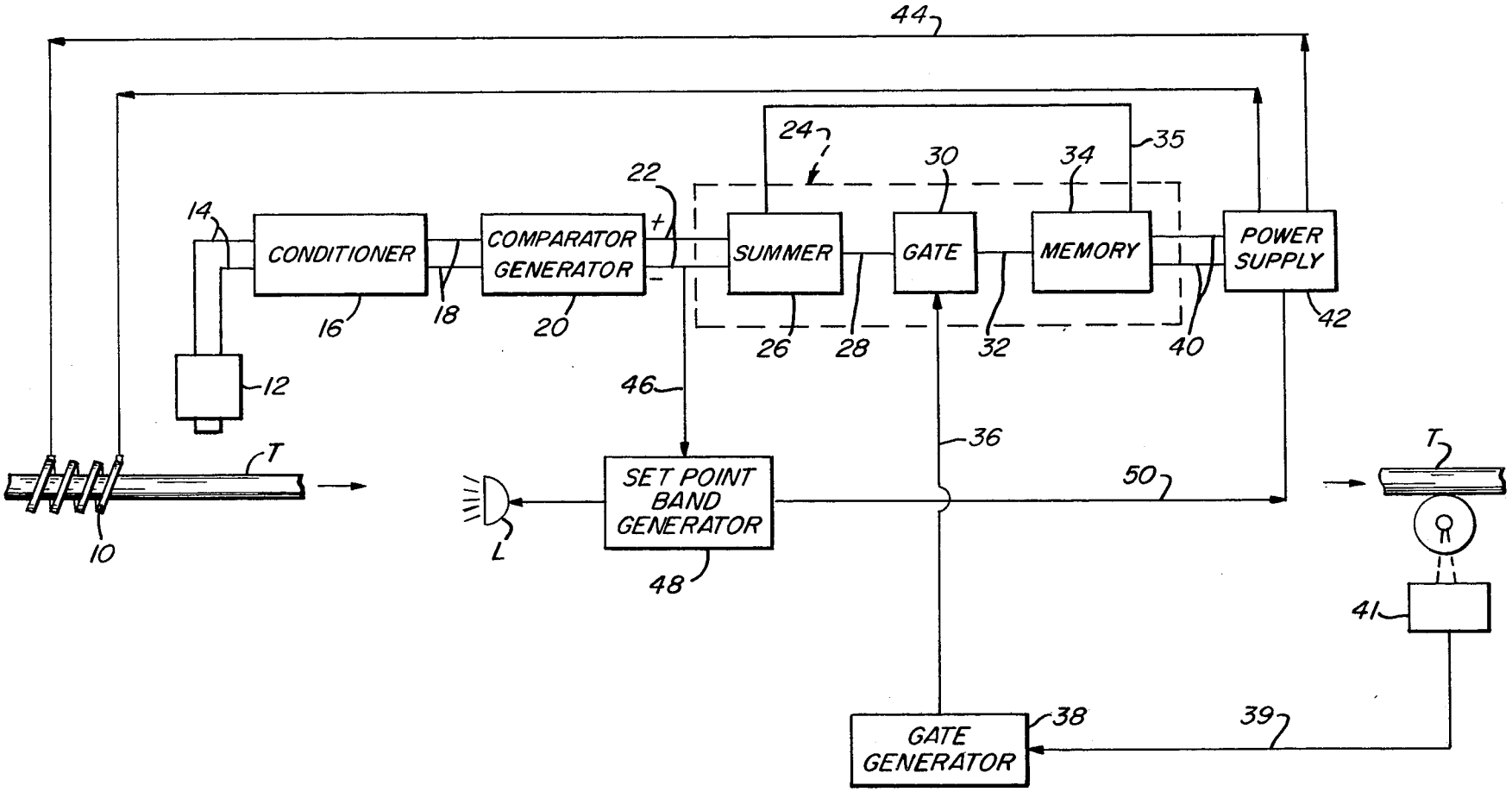
POWER SUPPLY
MEMORY
GATE
SUMMER
COMPARATOR GENERATOR
CONDITIONER
SET POINT BAND GENERATOR
GATE GENERATOR
T
T
L
10
12
14
16
18
20
22
24
26
28
30
32
34
35
36
38
39
40
41
42
44
46
48
50

TEMPERATURE CONTROL APPARATUS

In the manufacture of alloy tubing and specifically welded alloy tubing of stainless steel, it is customary practice to form a continuous strip or band of stainless steel into a tubular form by a roll-forming operation. During this roll-forming operation the edges of the strip are progressively bent until they touch to form a longitudinal seam. This seam is then joined by a longitudinal welding operation. The metal of the tubing affected by this welding operation takes on an undesirable cast structure, which structure does not exhibit the desired properties such as good corrosion resistance. It is, therefore, typical in the manufacture of welded stainless steel tubing to subject the tubing after welding to an annealing treatment wherein the tubing is heated for a time at temperature sufficient to achieve recrystallization of the metal. Typically, this annealing treatment is performed in a continuous furnace having an induction heating coil through which the tubing is moved in a continuous fashion by a series of spaced-apart drive rolls on which the tubing is supported and carried through the annealing furnace. The rate of travel of the tubing through the furnace is dependent upon the tube section, annealing treatment desired, time at temperature and the like. After annealing, generally the tubing is subjected to an acid pickling operation which may be followed by straightening, cutting, inspection and testing.

During annealing it is necessary to heat stainless steel tubing, depending upon composition, to a temperature within the range of 1950° to 2050° F. At the higher temperatures within this annealing temperature range the melting temperature of the alloy of the composition is approached. Hence, temperature control at this upper end of the annealing temperature range is quite critical since a deviation of a few degrees higher than necessary may result in softening of the tubing to the point that bending thereof results. If, on the other hand, the temperature is too low the desired annealed structure necessary for achieving the desired properties, such as corrosion resistance, will not be achieved.

It is accordingly the primary object of the present invention to provide an electrical control apparatus for controlling the power to the induction heating coil in the annealing furnace in a manner that insures uniform heating of the tubing passing therethrough.

This and other objects of the invention, as well as a more complete understanding thereof, may be obtained from the following description, specific example and drawing, in which the single FIGURE thereof is a schematic, block diagram of one embodiment of apparatus in accordance with the practice of the invention.

Broadly, the control apparatus of the invention is used in conjunction with a typical annealing furnace for stainless steel tubing, which furnace, in the well known and conventional manner, comprises an induction heating coil located within an elongated furnace chamber through which tubing is continuously moved at a predetermined rate of speed by means such as a series of drive rolls. The furnace is refractory insulated and has entry and exit openings at either end conforming substantially to the diameter of the tubing, all for the purpose of maintaining furnace temperature. The control apparatus of the invention includes an optical pyrometer located to sight onto the tubing as it leaves the induction heating coil. The electrical signal from the pyrometer is therefore proportional to the temperature of the tubing after heating by the induction coil. This electrical signal from the pyrometer is compared to a set point signal proportional to the desired temperature of the tubing at the location at which the pyrometer makes the temperature determination. If the pyrometer signal differs from the set point signal an error signal having a polarity corresponding to the direction of any said deviation and a magnitude corresponding to the magnitude of any said deviation is produced. In addition, an electrical signal proportional to the existing power level to the induction coil is provided. This power level signal and any error signal are summed to produce a control signal which is used to adjust the power level of the induction coil so that it heats the workpiece to substantially the desired temperature. The power level signal and the error signal are summed at a preselected interval, which interval is of a duration that the affect of any control or adjustment of the power supply to the induction coil results in a change of the tubing temperature at the location of the pyrometer before an additional summing operation and thus possible control action is effected. In this manner over-correction, termed as "hunting", is minimized or avoided. Means are provided in addition for changing the direction of the preselected interval at which the power level signal and error signal are summed in response to changes in the speed of the tubing moving through the induction heating coil. Also, means may be provided for additionally comparing the error signal to a set point band which corresponds to a preselected tubing temperature range at the location of the pyrometer. If the temperature of the tubing is above or below this temperature range a signal is produced so that the operator may assume manual control or shut down the line. In addition, means may be provided in response to this signal for automatically terminating power to the induction coil when the tubing temperature is outside the preselected tubing temperature range.

With respect to the drawing, there is shown schematically an induction coil 10 through which tubing, designated as "T", passes for heating. It is to be understood that in the conventional manner this induction coil and tubing are within an elongated furnace chamber (not shown). As the tubing "T" exits from the induction coil, an optical pyrometer 12 sights onto the tubing and produces an electrical signal across conductor 14 proportional to the temperature of the tubing as it exits from the induction heating coil. This signal is introduced to a conventional signal conditioner 16 that conditions the signal by removing amplitude irregularities, which function is conventionally termed "cleaning up" the signal so that it may be effectively used in the control apparatus. The conditioner includes a standard high input direct-current amplifier circuit with high adjustable gain and standard offset adjustments. This component may, for example, be the amplifier identified in National Semiconductor Linear Handbook (1978) pages 3–156 and 157. The conditioned signal proportional to the temperature of the tubing is introduced via conductors 18 to a set point comparator generator 20 that compares the signal from conditioner 16 to a set point signal corresponding to the desired temperature of the workpiece at the point relative to the induction heating coil at which the temperature determination is made by the optical pyrometer 12. This set point comparator generator 20 has a conventional summing network with an amplifier to amplify any difference signal constituting an error signal. If the signal from conditioner 16 differs from the set point signal an error signal is provided across conductor 22. This error signal has a polarity corresponding to the direction of deviation and an amplitude corresponding to the magnitude of any deviation. It may be seen, therefore, that this signal from the standpoint of polarity indicates whether the temperature of the tubing as determined by the pyrometer 12 is above or below the set point signal representing the desired or preselected temperature. Likewise, the amplitude of the signal across conductor 22 indicates the magnitude of any said temperature deviation from the preselected temperature. Any error signal across conductor 22 is introduced to a memory gate 24. The memory gate 24 includes a summing amplifier 26, which is a conventional summing network that adds "old" memory to error to produce a "new" memory signal level, connected via conductor 28 to a gate or switch 30 which in turn is connected via conductor 32 to a memory circuit 34 that in the conventional manner includes a charged capacitor and a buffer amplifier and is commonly called a "sample and hold amplifier". The gate 30 is connected via conductor 36 to a gate generator 38 for enabling the switch 30. The gate generator 38 is a conventional oscillator and frequency divider. Gate generator 38 receives via conductor 39 an electrical signal from tachometer wheel 41 which is in contact with tubing "T"; the signal via conductor 39 is proportional to the line speed of the tubing through the induction coil. The gate generator divides this tachometer signal and the resulting signal is introduced to gate 30 of memory gate 24. The memory gate 24 is connected via conductor 40 to power supply 42 which through conductors 44 is connected to and powers the induction heating coil 10.

The error signal from set point comparator generator 20, in addition to being introduced to memory gate 24, is introduced via conductor 46 to a set point band generator 48 including a conventional level detector circuit to detect when the error signal voltage level exceeds a preselected value. The set point band generator 48 via conductor 50 is connected to power supply 42 for the induction heating coil 10.

Any error signal introduced to the memory gate 24 from set point comparator generator 20 via conductors 22 is in the conventional manner summed in summer 26 and if gate 30 is enabled any said error signal passes through the gate and to memory unit 34 via conductor 32. Memory 34 via conductor 35 generates a signal proportional to the existing power level to the induction coil from power supply 42 to summer 26 so that the error signal introduced to summer 26 is compared to this power level signal in producing the control signal across conductors 40. The gate generator 38 via conductor 36 enables gate 30 at preselected intervals relative to the speed of tubing travel so that the control signal across conductor 40 to the power supply is produced only at the preselected intervals and therefore will not result in over-control and thus drastic temperature variations in the tubing.

The tachometer wheel 41 connected to the gate generator 38 via conductor 39 permits changing of the interval in response to changes in the speed of the tubing through the coil so that the line speed is considered in determining and maintaining the proper interval for control of the power supply to the induction coil in response to the control signal. The error signal from set point comparator generator 20 introduced via conductor 46 to set point band generator 48 is compared to the set point band and if the increase is above or below the set point band a signal may be produced to sound an alarm such as activation of a signal lamp designated at "L" and to provide a signal through conductor 50 to induction coil power supply 42 to shut down the power supply to the coil. The set point band generator 48 may be, for example, the Level Detector with Lamp Device identified in National Semiconductor Linear Handbook (1978) page 5–50.

I claim:

1. Apparatus for controlling the temperature of an elongated metal workpiece, such as pipe or tubing, that is moving through a furnace chamber by regulating the power level of an induction heating coil used for heating said product within said furnace chamber, said apparatus comprising means for moving said workpiece through an induction heating coil where it is heated to an elevated temperature, a pyrometer at a location relative to said workpiece to produce an electrical signal proportional to the temperature of said workpiece after heating by said induction coil, means for comparing a set point signal proportional to the desired temperature of said workpiece at the location of said pyrometer with said electrical signal from said pyrometer to produce an error signal having a polarity corresponding to the direction of any deviation of said pyrometer electrical signal from said set point signal and a magnitude corresponding to the magnitude of any said deviation, means for producing an electrical signal proportional to the existing power level of said induction coil, means for summing said power level signal and said error signal at a preselected interval to produce a control signal, said summing means includes additional means for changing the duration of said preselected interval in response to a change in speed of said workpiece moving through said induction heating coil, and means for receiving said control signal and adjusting the power supplied to said induction coil in response thereto, whereby the temperature of said workpiece is maintained at substantially said desired temperature.

2. The apparatus of claim 1 including means for comparing said error signal to a set point band corresponding to preselected temperature range having limits above and below said desired temperature of said workpiece and means for producing a second error signal if the temperature is outside said preselected range.

3. The apparatus of claim 2 including means for terminating power to said induction coil in response to said second error signal.

* * * * *